US006045297A

United States Patent [19]

Voorhees et al.

[11] Patent Number: 6,045,297

[45] Date of Patent: Apr. 4, 2000

[54] METHOD AND APPARATUS FOR DRILLING RIG CONSTRUCTION AND MOBILIZATION

[76] Inventors: Ronald J. Voorhees, 1011 Hwy. 6, Suite 115, Houston, Tex. 77077; Ronald B. Tinkham, 1059 San Patricio, Solana Beach, Calif. 92075

[21] Appl. No.: 09/160,283

[22] Filed: Sep. 24, 1998

[51] Int. Cl.[7] ..... E02D 3/02

[52] U.S. Cl. ..... 405/303; 52/651.05; 180/116; 212/175; 212/294; 405/232

[58] Field of Search ..... 405/232, 231, 405/303; 180/116–121; 52/651.05, 651.01, 651.07, 110, 111, 116, 745.15; 212/294, 175

[56] References Cited

U.S. PATENT DOCUMENTS

| | | | |
|---|---|---|---|
| 3,783,627 | 1/1974 | Blurton et al. | 405/217 |
| 3,832,858 | 9/1974 | Anders | 405/223 |
| 3,844,126 | 10/1974 | Blurton et al. | 405/217 |
| 4,237,992 | 12/1980 | Bristow | 180/116 |
| 4,440,253 | 4/1984 | Pernum | 180/116 |
| 4,555,032 | 11/1985 | Mick et al. | 212/189 |
| 5,871,061 | 2/1999 | Ashton | 180/117 X |

*Primary Examiner*—Dennis L. Taylor
*Attorney, Agent, or Firm*—Gunn & Associates, P.C.

[57] ABSTRACT

The present disclosure is directed to a method and apparatus for drilling rig mobilization and demobilization. The rig is assembled or constructed at a remote site. It is later taken apart and transported to another remote site or back to a staging point. The rig itself comprises a rig floor which is supported on a set of vertical rig legs which support the rig floor for movement between raised and lowered positions. An equipment module is preferably installed on the rig floor. It goes above the rig floor while other modules are attached under the rig floor and provide additional equipment and service space. The method involves the transportation of the rig floor, the legs, equipment module and other modules to and from the rig site by hover craft while riding on a top deck on the hover craft for lateral transfer and installation.

20 Claims, 4 Drawing Sheets

FIG.1
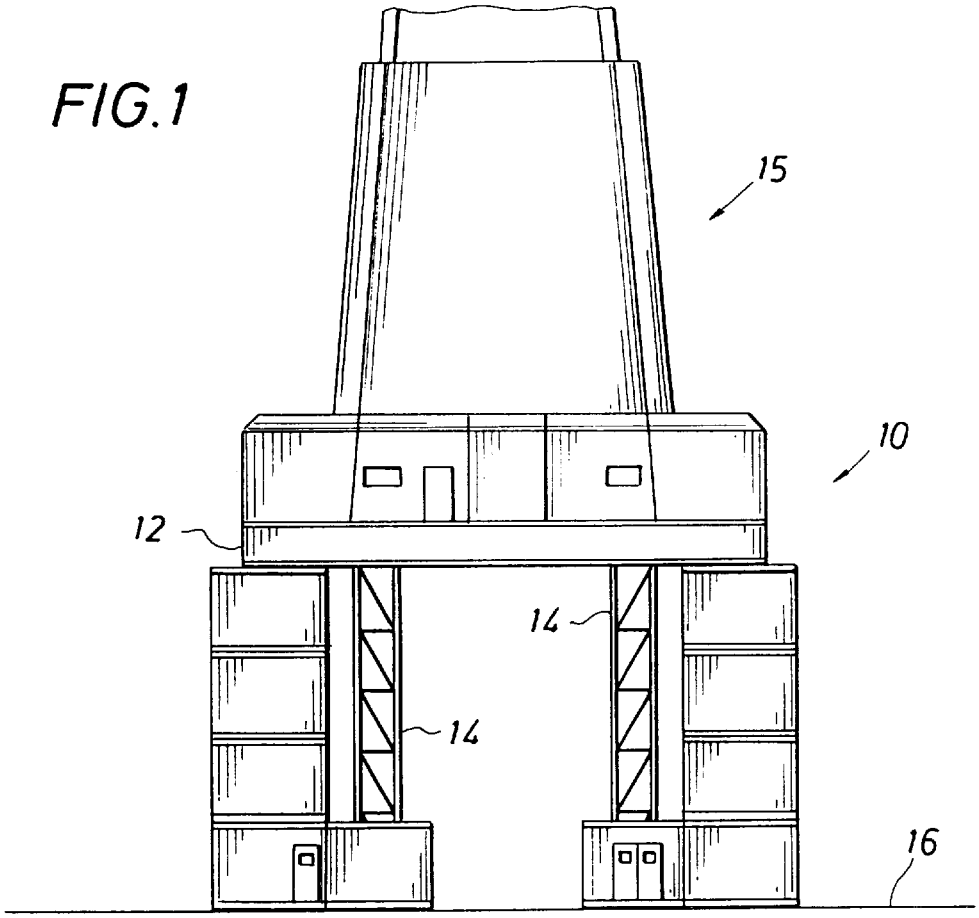
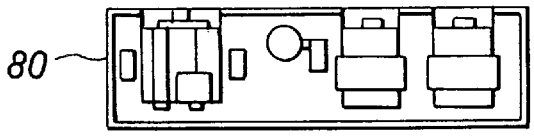
FIG. 2
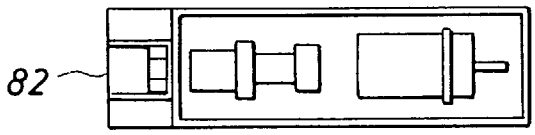
FIG. 3

METHOD AND APPARATUS FOR DRILLING RIG CONSTRUCTION AND MOBILIZATION

BACKGROUND OF THE DISCLOSURE

This disclosure is directed to both a method and an apparatus involved in drilling rig construction. Drilling rig construction at a field location in the lower forty-eight states on land normally is no problem. A drilling rig is simply moved by trucks to the location where it is required, unloaded, assembled and left at that location for weeks. When the rig is through drilling, it is either disassembled or simply moved over to a nearby location. It is made in components which are modules sized to fit on a truck and is trucked into and away from the drilling rig site. Off shore, the entire drilling rig is integrated into a barge for drilling in shallow waters, or is arranged in a jack up rig. Even larger versions involve semi-submersible rectangular vessels which have tanks which are partly filled with water to control bouyancy. In all these instances, transportation to and from the area involves either barge traffic or truck traffic. In northern latitudes, the problem is not so easy. At most times of the year, barge traffic is not possible because water is frozen. Truck traffic is not possible because there are literally no roads and the wilderness is simply impassable for trucks. Even where trucks can drive, there is the necessity of building a road of special construction which can be used both winter and summer. The problem is not so much in the winter when the temperatures go perhaps to −50° F. The problem with these roads arises in the summer because such roads require construction of gravel pack on the terrain. In the summer, there is a progressive thawing which may damage the permafrost layer at the top of the earth. The permafrost barrier, once thawed, resembles a sponge and is structurally unreliable. It creates great difficulties in transportation, and also creates comparable difficulties in repair after use. Suffice it to say, such difficulties arise for roads which can be built for heavy traffic (meaning both volume and weight). Gravel roads are not readily available in the northern reaches of the western continents. Effectively, truck traffic is simply forbidden.

By contrast, helicopter lifting can be done in some instances, but helicopters are not able to handle entire drilling rigs. If the rig is broken down, it can be lifted in and out by means of helicopter. That, however, has its own set of problems. Helicopter transportation of rig components is highly desirable in some instances, but it is generally best done to a rig location already implemented. Transportation by helicopter to a rig location (having no landing pad) begs the question ordinarily because it contemplates use of an equipped rig site which is merely serviced by helicopter delivery of freight.

The present disclosure sets out an improved mode of installing a drilling rig at a site that is well off the beaten path, perhaps 100 miles or more away from the nearest work camp. This is certainly true in northern latitudes. It is also true in a number of other circumstances in the lower forty-eight states. To pick an example, the rig site can be at least fifty miles from the nearest road in many areas of Montana, both Dakotas, and Wyoming. The intervening area may be rolling terrain which is essentially prairie with undulating hills. In the four corners area, it may be desert regions or isolated at the far corner of some Indian reservation. In the gulf coast area, the rig site can be in the midst of a swamp including the Florida Everglades, or the delta region of Louisiana. In all these instances, the nearest paved road (or at least gravel service road) is many miles away while the rig needs to be erected, both conveniently and without leaving a destructive trail behind. After well completion, casing the well and connection with a collection line, most of the equipment at the rig site is removed. Indeed, the only thing left visible on the ground is well head equipment for control of fluid production.

Suffice it to say, rigs must be mobilized from a yard or a facility, moved out into the wilderness, travel some distance where roads simply do not exist, erected, and subsequently the rigs are then returned to the storage yard. Each rig site poses comparable problems of lesser or greater scale focusing on transportation to and then from the rig site. To consider now the present disclosure, it sets forth a method and apparatus incorporating hover craft to set up a drilling rig. Moreover, it enables a drilling rig to be put together in the field and removed so that the rig site itself is little disturbed and the immediate vicinity at the rig site is not overburdened by putting the rig there. When the rig is removed, the process is reversed so that the rig components are taken out, substantially in the same fashion, and are removed to another location. With this approach, the rig can be taken apart piece by piece, transported and moved with great ease. The actual velocity of rig movement across the unfriendly terrain is much faster using the present invention than would be the case by transporting it on trailers pulled by heavy duty off road vehicles.

One aspect of the present disclosure features hover craft. There is an industrial sized hover craft readily available which is constructed with a relatively thin dimension (measured vertically), and which has a top located cargo deck. While various sizes exist, a commercially available hover craft is preferably used which has a loading deck measuring 51×32 feet having suitable tie downs for support of modular cargo. This kind of device can be loaded at a staging yard and then flown over the terrain leaving minimal disturbance to the terrain. The hover craft when passing over open terrain has a footprint or weight on the ground which is less than a person walking on the ground. Considering an average sized man with a weight of 180 pounds, the weight of that person in conventional shoes is greater than the loading of the hover craft. Considering the same person walking across the snow covered northern latitudes of Alaska and Canada, their weight on typical snow shoes approaches the loading on the ground provided by the present hover craft assisted mobilization procedure. More will be noted regarding that benefit below. In another aspect, the present disclosure contemplates drilling rig construction in the wilderness so that drilling site disturbances are held to a minimum. Where permafrost is involved, the permafrost itself is not disturbed. This avoids creating highly undesirable bogs or soft spots in the area of permafrost damage.

The present disclosure is directed to a method of erecting a drilling rig and will be detailed in the context of northern problems, i.e. permafrost in the earth which is beneath several feet of accumulated snow or ice. In like fashion, the present procedure can be adapted for use in swamps or out on the desert where the footing is shifting sand.

SUMMARY OF THE PRESENT DISCLOSURE

This disclosure sets out an apparatus which is erected in the field. A drilling rig floor of rectangular construction is supported on four upstanding legs. The legs are erected to a height typically of about 60–80 feet depending on the height of the rig construction. The rig floor serves as the reference plane or table; certain components are placed above it while other components are placed below it. In both instances, modular rectangular components are anchored to the rig floor. The rig floor is supported on the set of legs, four being the preferred number so that the rig floor is preferably hydraulically lifted during rig fabrication. The assembly in the field is assisted by moving the rig up and down on the legs. Through the use of pin locking clamp mechanisms, the rig floor is fastened securely on the rig legs. This enables the rig floor to be raised progressively so that different components are added to the partly finished drilling rig. These are transported to the rig site on hover craft.

BRIEF DISCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 1 is a side view of a completed drilling rig showing modular components above and stacked modular components below the rig floor;

FIGS. 2–5 show floor plans of drilling rig modules and equipment for the drilling rig;

DETAILED DESCRIPTION OF THE PREFERRED EMBODIMENT

Figure 4:
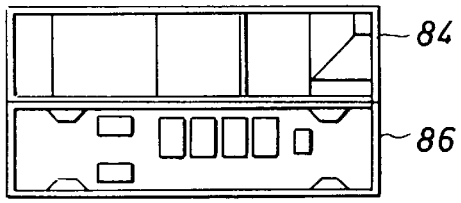

Attention is first directed to FIG. 1 of the drawings where a finished drilling rig in accordance with the present disclosure is shown. The drilling rig 10 is constructed in modular fashion. The drilling rig 10 is supported on a rig floor 12. Above that, there is the upstanding drilling rig mast 15. The drilling rig is supported on four similar rig legs 14. They are deployed in a rectangular fashion to support the rig weight on the earth below. The earth or the soil of the earth, speaking more technically, is identified at 16. Because this can vary widely from swamps to desert to frozen tundra, added detail and explanation will be provided. A number of individual modules are placed in the rig 10 to complete it.

For purposes of nomenclature, the term "rig floor" will be used to describe a commonly rectangular frame work. This frame work 12 has a finite thickness. It is normally constructed as a rectangle or perhaps as a square. Triangular rigs also exist, but the preferred form is a rectangle. The legs 14 are deployed towards the four corners. They can be near the edges or at the four corners if desired. Variations on this will be noted, for instance, the rig floor 12 shown in FIG. 1 has some over hang, i.e. the legs are inset from the edges of the rig floor. Continuing, the rig floor is constructed with a vertical thickness of perhaps of up to about 10 feet. It normally is an enclosed framework. The top side of the rig floor is steel plates forming a deck. The bottom side is typically also plated. The bottom side of the rig floor is constructed with a number of fasteners protruding downwardly, such fasteners being known typically as quarter turn twist locks. These are implemented to hold the modules which hang below the rig floor. Details such as this are incorporated by reference because such fasteners are well known.

The rig floor is constructed with openings for the legs 14. Preferably, the legs are open frame works. An acceptable construction is obtained with triangular or rectangular frames. There are vertical columns in the several legs. A three or four cornered leg construction is commonplace. Diagonal braces are shown in the legs. Typical leg construction for this type equipment involves a leg of four to nine feet in diameter. The vertical columns making up the three or four corners of the legs are about six to ten inch diameter pipe or H-beams having six to eight inch width flanges. Again, specifics of the leg construction are believed well established. The legs (up to about 80 feet) are similar to the leg construction involved in jack up barges. Jack up barges exist to day with legs as much as 300 feet tall and 30 to 40 feet in diameter. Recently, jack up rigs have been announced with legs over 500 feet in height. It is well known in jack up rigs to move the legs with a transport mechanism between the rig floor 12 and the legs 14. One approach is use of a rack and pinion to raise or lower the legs. It is preferable in this instance to use legs which are raised and lowered with a hydraulic powered ratchet mechanism. Details of this will be given below.

A representative set of modules is shown in FIGS. 1–5. These are fastened to the rig floor 12 to provide enclosed work areas. In a typical land rig installation, many of the tasks are done in portable work houses near the drilling rig, perhaps 50 to 100 feet away. It is not uncommon to haul five to ten work houses to the area. There might be a separate "shack" for a log analyst, another "shack" for the mud analyst, another "shack" for the electrician and so on. By contrast, the embodiment of this disclosure utilizes an integrated set of modules which connect to the rig floor to enclose all of the work areas and all of the equipment within the respective modules.

Some of these modules will be discussed in detail in describing the various components shown in FIGS. 1–5. Assume for purposes of discussion that all the components shown in FIGS. 1–5 are located in a yard at some location and it is necessary to move the components to a remote rig site. The remote location is across swamp, desert, or frozen tundra. The latter will be used as an example because it is the more difficult of the situations. This example will illustrate how the rig is moved. The assumption is that the rig will then be taken out of the yard and deployed to such a difficult remote location. Site assembly is exemplified in FIG. 7 of the drawings. There, the number 18 identifies a layer of accumulated snow and ice above the earth 20. The earth 20 in this instance is assumed to be permafrost. It is buried under the overburden of snow and ice. The overburden can be any depth. It is important to install the drilling rig on a firm footing provided by the soil layer 20. Even under shifting sandy deserts or southern swamps, there is a layer 20 which is reasonably firm which provides a footing for the installation of the drilling rig.

Figure 7:
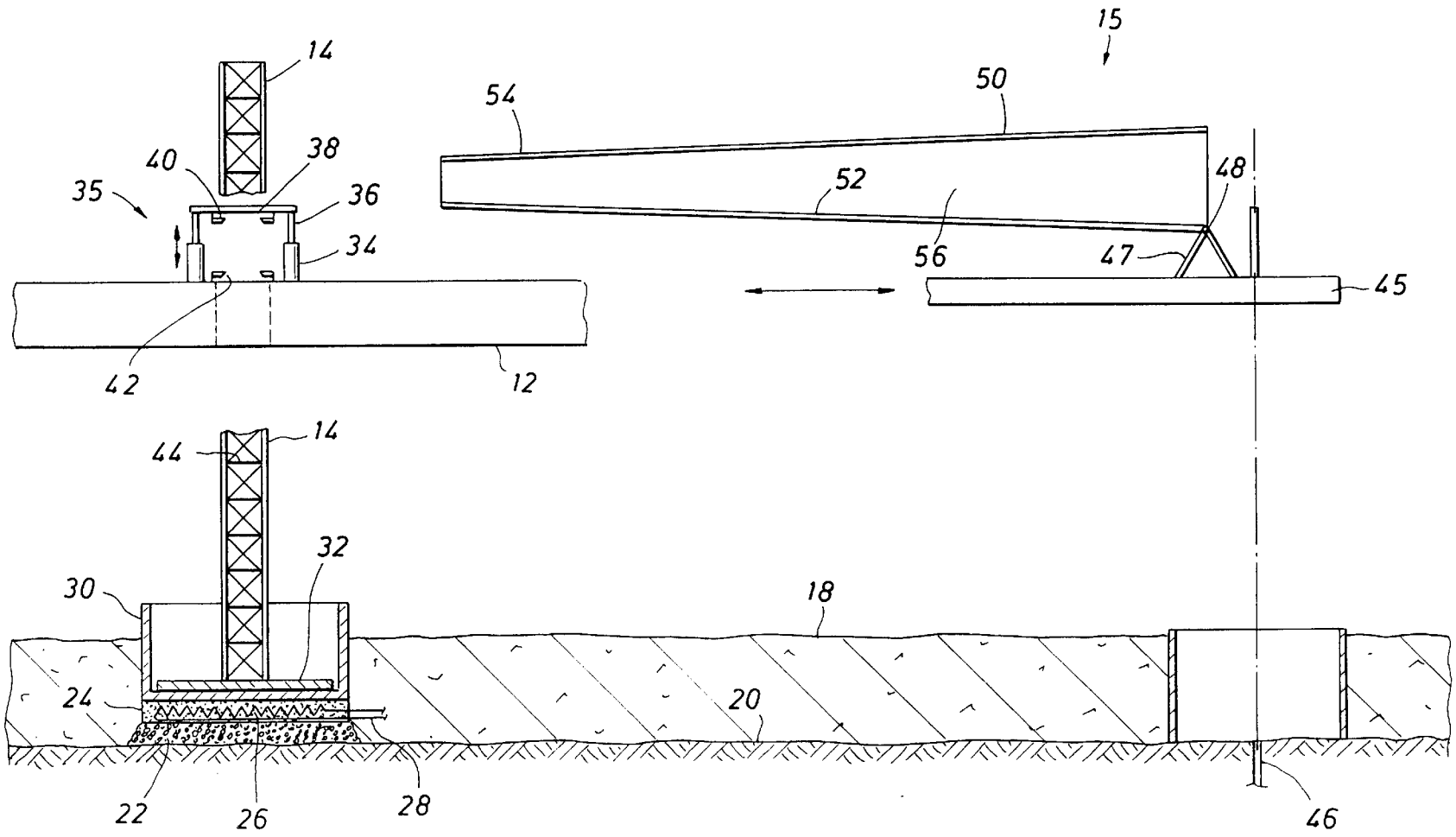
FIG. 7 is a side view of the partially assembled drilling rig during assembly and showing its position above the earth.

FIG. 7 depicts the permafrost layer. To evenly and completely distribute the weight, the accumulated snow and ice is moved away, and a gravel pad 22 is installed on the solid soil layer (a layer made hard by the permafrost). The pad 22 is typically a circular pad of a few inches thickness. It is formed of gravel to provide relatively even distribution of weight across the area. It is typically circular, and can be 10 to 30 feet in diameter. If desired, the entire area under the rig floor can be cleared of snow, an area of rectangular shape. The gravel pad 22 is built up to about one or two feet in thickness. This pad levels the support area. Over that, a chilled resilient pad 24 is placed. It serves as a thermal barrier. It is incorporated to prevent heat transfer into the permafrost layer 20. In fact, the preferred form is a resilient pad 24 having a tube 26 in it for distribution of a flowing coolant. The coolant is delivered by inlet and outlet lines 28. The coolant chills the pad 24 to assure that the permafrost is not damaged. The pad 24 is preferably resilient for localized deformation while resting on the gravel pack layer 22. Again, the pad is preferably sized to fit over the gravel pad 22 so that it spreads the weight over the circular region.

An open cylindrical boot 30 is placed above the resilient pad 24. This has a wall which is sufficiently tall that it keeps out the snow at least at the time of construction. The boot 30 is an open tank and has an optional storage function if desired. The tank being provided with the upstanding side walls. The tank supports a base plate 32 which is under the leg 14. The base plate 32 spreads the weight from the leg to the full dimension of the tank 30 and transfers that weight through the pad 2 4 into the gravel pack 22 and the earth 20 there below. As will be understood the weight which is placed on the earth is calculated to assure appropriate loading. The rig load on the permafrost requires an initial survey of the permafrost layer 20 and the loading which it can tolerate without puncture. It is generally undesirable that the rig leg puncture or penetrate into the permafrost layer. The soil is the solid footing under the illustrated equipment.

The leg 14 has a specified height as mentioned, and extends up through the rig floor 12. The rig floor 12 carries a ratchet mechanism 35 which locks to the leg 14 to enable the rig floor 12 to be raised or lowered.

The ratchet mechanism is not significantly different from such a mechanism shown in U.S. Pat. No. 3,508,409 which issued on Apr. 28, 1970. In this instance, the rig floor is raised in a synchronized fashion by operation of similar devices with every leg supporting the rig floor 12. In effect, the rig is raised evenly above the permafrost foundation 20. Movement of the rig floor is obtained by operation of the double acting hydraulic cylinders 34 which extend the piston rods 36. These connect with a clamp ring 38.

The clamp ring is raised or lowered under hydraulic power. As indicated by the arrow in FIG. 7, the lock ring 38 is powered up and down by the attached hydraulic cylinders. The ring fully circumscribes the leg 14. The ring supports a set of lock pins 40. The lock pins 40 connect to the leg 14. This locks the ring when desired. Lock pins are released from the leg during transportation up or down as will be explained.

A second set of lock pins 42 is anchored to the rig floor. Either the pins 40 or the pins 42 are locked. One set is always connected with the rig and the leg. Explaining, assume that the lock pins 42 are locked against the leg 14. The pins are mounted so that they insert into the leg and hold fast against the leg. The lock pins preferably align so that they lock against some transverse surface on the legs and such surface is obtained by the transverse frame members 44. The pins 40 or 42 lock against the transverse frame member 44. When the pins 42 are inserted, the pins 40 can be retracted. Then the hydraulic cylinders 34 are operated to raise or lower the ring 38. The ring 38 is moved along the length of the leg 14 to a new position. For raising the rig floor, the hydraulic cylinders 34 extend the piston rods 36. This raises the ring 38. The pins are inserted after the ring has been raised. This locks the pins 40 against transverse frame members. Then, the pins 42 are disconnected from the legs 14. At that moment, all the weight has shifted so that weight is transferred to the leg 14 through the pins 40. The hydraulic cylinders 34 are operated, and the piston rods are retracted. This has the net effect of raising the rig floor. The rig floor is ratcheted along the leg 14 by this sequential "reach and grab action". The rig floor is lowered by reversing the sequence of steps. The rig floor commonly is raised at the time of assembly in the field. That will be discussed in detail below. Alternative leg raising mechanisms include a rack and a pinion used on jack up rigs or a multiple stage hydraulic cylinder.

The present drilling rig 10 includes the mast 15 shown in FIG. 1. That can have several different forms and a representative form is illustrated in FIG. 7. The mast 15 is known as a tilt up derrick. The tilt up derrick is constructed with telescoping sections as will be explained. First, however, the connection of the derrick 15 with respect to the rig floor 12 is noted. It is supported by connecting it directly to the rig floor 12. It is, however, possible for the rectangular rig floor to support the derrick 15 on a cantilevered base 45. The base 45 is moved into the rig and connects with it. It slides into the rig floor or slides out to cantilever the derrick beyond the edge of the rectangular floor. By that approach, the drilling rig drills a well borehole not located between the four legs that support the rig floor. The derrick is located out to the side and the borehole is displaced to the side of the four legs. The base 45 for the derrick is cantilevered so that it telescopes to and fro. This motion enables adjustments at the field location. Assume for instance that the rig floor is precisely square with a spacing of 60 feet between the center line axis of each of the four legs. With that kind of spacing, the derrick is moved out to the side so there is no problem with crowding the blow out preventors (BOP) and the associated equipment between the legs. Greater access is obtained at the side.

Continuing therefore with FIG. 7, the accumulated ice and snow is removed from the location for the borehole 46 shown at the right corner of FIG. 7. The cantilevered base 45 is moved to an aligned position with the borehole 46. The derrick itself rests on a triangular frame 47 which supports a pivot point 48. The vertical riser 50 is a pair of parallel vertical columns. The derrick tapers somewhat and is smaller in the illustrated dimension at the top. There are four legs in the derrick so that it is rectangular in cross section. The legs 52 provide the taper just mentioned. They swing around the pivot 48. This rectangular derrick supports the weight of the drill pipe during drilling. The derrick has an upper section 54 which telescopes into the lower section 56. This shortens the derrick for transportation and storage. The derrick is shown in the retracted position, that being the full line position of FIG. 7. It is rotated so that it pivots 90° to an upright posture. Appropriately, the upstanding derrick is anchored to the base 45. Alternative derricks include other tilt up masts, or supported masts.

Figure 6:
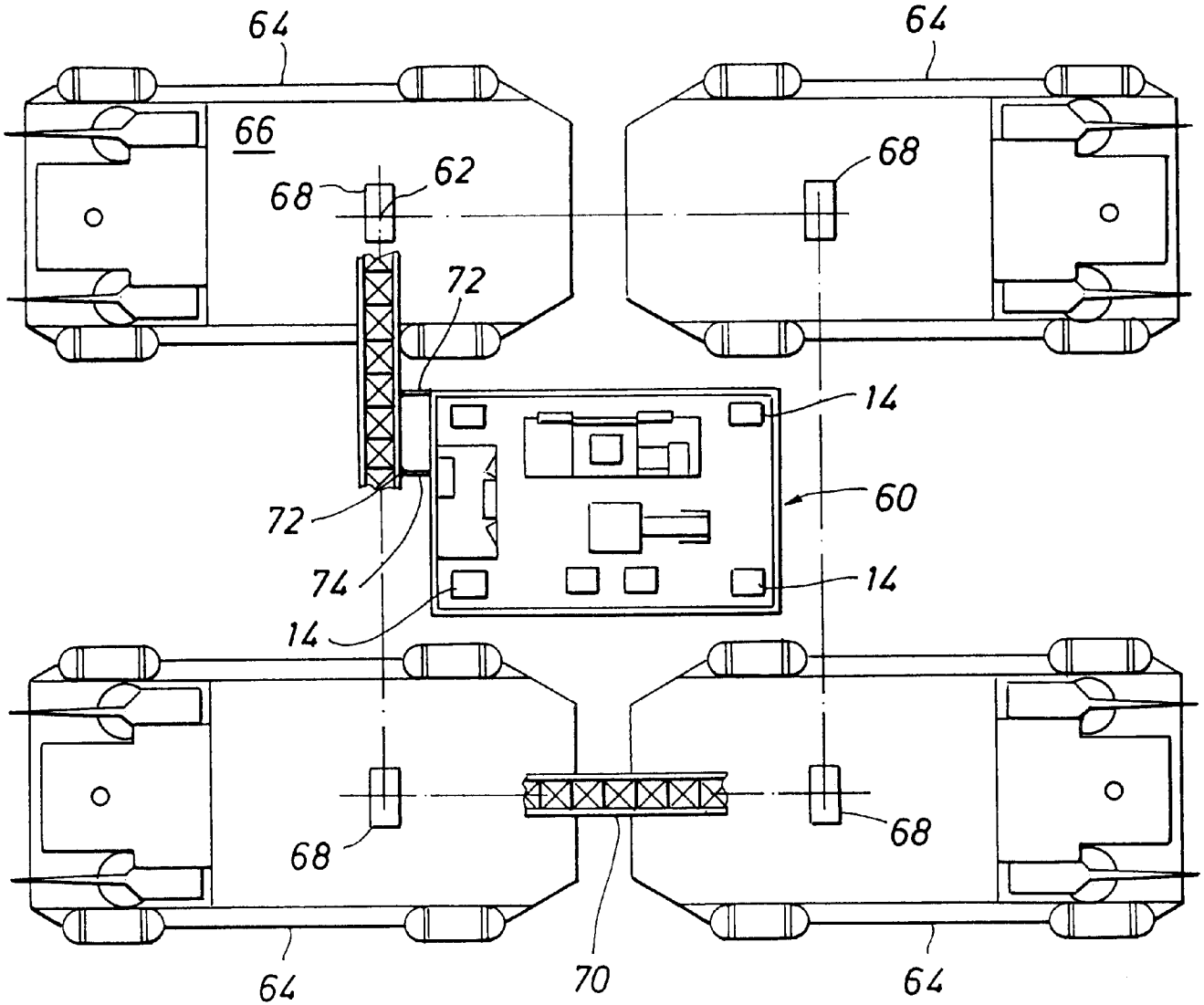
FIG. 6 is a plan view of a rig module carried by four hover craft for transportation to the rig site.

Assume for purposes of description that the rig floor 12 is an independent unit. It supports one or more closed modules erected on the rig floor 12 and to the side of the derrick 15 just described. This rectangular housing comprises the modular package 60 shown in FIG. 6. In the alternative, the module 60 can be constructed integral with the rig floor 12. FIG. 6 also illustrates the respective locations for the derrick legs 14 through the openings at the respective corners. The unit 60 of modular construction resembles a rectangle having substantial equipment in it. It is usually so heavy that it normally cannot be handled by a single hover craft.

Sometimes, six are needed and they are connected in the same fashion. FIG. 6 shows four similar hover craft deployed at the four corners of the rectangular equipment module 60. They are used for lifting it. Focusing on the upper left hover craft, it has a central point 62 for the hover craft 64 which is the center of gravity of the load. The load is mounted so that the weight is at the point 62 or, restated, is distributed so that the centroid of the weight is at that location. The cargo deck of the hover craft 66 is typically 51' by 32' in a particular model. The four hover craft are identical in construction except they are positioned back to back as illustrated in FIG. 6. This back to back arrangement locates the loading point 62 as close as possible to the heavy equipment module 60. The loading point 62 is provided with a reinforced pad 68 exemplified in FIG. 6. A simple rectangular frame comprised of a frame member 70 (only partially illustrated in FIG. 6) extends to the pad 68 on each of the four, and this frame connects to the equipment module 60 at the segment 72. The frame is releasable connected at 74. Several such connections are included so that the weight of the module deck 60 is shifted to the frame components 70 and 72. They make up a rectangular frame which transfers the weight of the module 60. The equipment module 60 is installed in conjunction with the rig floor 12 as will be described.

Returning now to FIG. 1 of the drawings, assume for purposes of discussion that the rig is located in the far tundra and has the appearance shown at 10 after assembly. The first assembly steps are carried out by locating the four legs 14. More specifically, the four legs are located at the desired spacing. They are placed on the permafrost layer 20 which serves as a foundation by removing the snow and ice layer 18, installing the gravel pad 22, the chilled resilient pad 24 and the cylindrical boot 30. The leg is positioned in the pad. All of the foregoing is done by hover craft movement of the leg 14 to the location desired. By removal assisted with appropriate equipment, the snow and ice is pushed aside or otherwise moved, the foundation 20 then is exposed and the circular leg support region is then constructed. All of this can be done with relative dispatch. All the equipment shown at the lower left in FIG. 7 is carried on a single hover craft. This enables the gravel pad to be installed, the resilient pad above it, the cylindrical boot above that. Typically, the leg 14 bolts and unbolts for easy connection. Connection to the plate 32 is done in the field if desired. All four corners are appropriately located and positioned. After that, the rig floor 12 is moved by hover craft to this location. Ideally, the cylindrical boots extend to the level of the snow and ice, but need not extend much above that. The next step is carried out by moving the rig floor 12 to the location above the four boots 30. Momentarily, the rig floor 12 is rested on the four boots.

Transportation of the rig equipment module 60 using multiple hover craft as illustrated in FIG. 6. When they arrive at the vicinity, they increase power to raise the hover craft a few feet so that the equipment module 60 will pass over the rig floor 12. It is supported on the rig floor. The hover craft will then disconnect it while the equipment deck 60 is anchored.

Next, the derrick 15 and its supported base 45 is moved to the rig floor, also. It is mounted on a hover craft, meaning one or more. They support the derrick in the same fashion shown in FIG. 6. The hover craft are used to approach the drilling rig floor 12 to position the cantilevered rig base 45 in the illustrated fashion. It is brought into operative cooperation with the rig floor 12. If there is no cantilevered base 45, the derrick is delivered with a base mounting mechanism which matches that found on the rig floor 12. The hover craft carry the derrick 15 to the rig floor 12 prior to elevation. Then, the base 45 under the derrick is installed, and this positions the derrick 15 for subsequent use. At this moment, there is no need yet to raise the derrick.

Again using hover craft, the legs 14 are moved to a position on the floor 12. They are positioned upright through the deck 12 at appropriate openings, and rest vertically in the respective boots 30. The rig floor 12 supports the four ratchet mechanisms 35 engaged with the four legs. At this point, the equipment in the field includes the four completed boots, the rig floor 12 above the four boots 30, the legs which are upright in the four boots, and the ratchet mechanisms 35. By operation of hydraulic equipment which is supported on the rig floor 12, the legs are engaged in pinned fashion so that the legs are advanced and leveled. The rig floor at this juncture is still only just a few feet above the surrounding layer of snow and ice.

Figure 8:
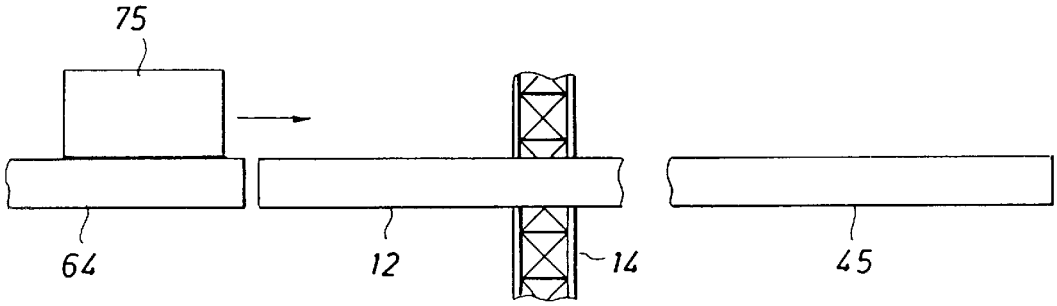
FIGS. 8, 9 and 10 collectively show a sequence of moving individual rig modules to the rig floor for assembly where transportation is provided by hover craft.

The next step is to level the rig floor 12 with respect to the legs, and raise the legs incrementally. There is nothing left to add on top of the rig floor 12. While that is true, there is nothing below the rig floor either. This requires raising the rig floor. This can be better seen by going momentarily to FIGS. 8, 9 and 10 considered jointly. This is a schematic drawing showing the rig floor 12 cooperative with one leg 14, it being realized that there are four legs supporting the rig floor, and they have been simplified so that the point can be made regarding sequence of assembly with these views. A hover craft 64 is shown delivering a modular unit 7 5 on board the hover craft 64. At this instance, the modular package is moved on top of the deck 12. FIG. 8 also illustrates the derrick base 45 connected to the rig floor 12. The derrick has been omitted for of clarity. The significant thing is that FIG. 8 shows module connection to the rig floor 12 either from the side or from above. In the latter instance, the module 75 is skidded off the hover craft and on to the rig floor 12.

Figure 9:
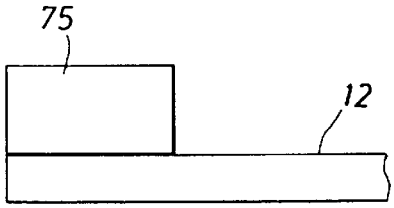
Figure 10:
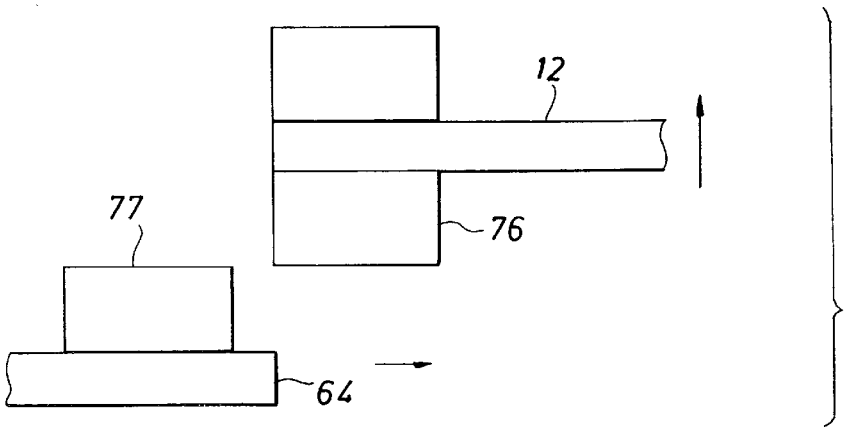

FIG. 9 shows the module 75 on the rig floor 12. It is anchored by appropriated mechanisms provided for that purpose. At this juncture, the rig floor 12 is loaded from above (see the module 75) and is prepared for additional loading, note the module 76 therebelow. That module is delivered on the cargo deck of a hover craft which moves the module to the desired location under the rig floor 12. By appropriate quarter turn twist locks or other fasteners, the module 76 is made fast to the rig floor 12, now over the module. That connection, when completed, enables the module 76 to be lifted from the hover craft. The hover craft elevate or drop down a few feet. For unloading, it is ordinarily above the snow and ice 18. Rather than lower the hover craft, relatively movement is obtained merely by raising the rig floor 12 which hoists the module 75. FIG. 10 shows sequentially the next step where another module 77 is hauled on the cargo deck of another hover craft 64. That hover craft slides in, so to speak, and locates the module 77 under the module 76. By use of the same preferred fasteners, this module 77 is connected under the module 76. Each time this is done, the rig floor is raised to unload the hover craft to enable the hover craft to slide away from the unloaded module when cleared of that load. After the hover craft is released from its weight, it backs out from under the load, and returns for another load. By this approach, first one and then two and then three underdecks can be assembled, so to speak, building from the floor 12 down. All this accomplished while raising the rig floor 12.

Going back now to FIG. 1, the several different modules are moved and installed as illustrated. They hang from the rig floor 12. Their weight is not on the snow pack. Their weight is transferred upwardly to the rig floor and from the rig floor to the legs by the ratchet mechanisms 35. As mentioned, the ratchet mechanisms are operated to controllably raise the rig floor 12. The rig floor is therefore initially positioned so low that hover craft can fly up next to it and slide a module off the side of the hover craft onto the rig floor. Later, the rig floor is raised so high that a hover craft can fly under it at least partly so that the module is unloaded upwardly, so to speak, by fastening to the overhead rig floor.

FIGS. 2, 3, 4 and 5 show floor plans for different modules. A representative module 80 is shown in FIG. 2 which incorporates mud cleaning equipment including desanders, shale shakers and the like. FIG. 3 shows a module 82 which carries a boiler which is appropriately needed to make steam for heating and energy. FIG. 4 shows modules 84 and 86.

Figure 5:
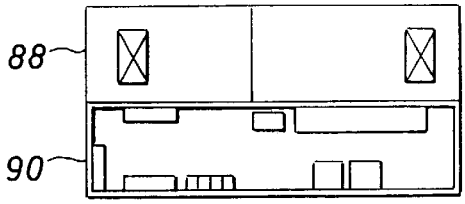

These modules include a set of tanks, and appropriate hoppers, pumps and other chemical storage equipment in the module 86. FIG. 5 shows several storage tanks in the module 88 and a workshop in the module 90. As will be understood, all the modules are appropriate enclosures for work areas, equipment storage, and servicing at the drilling rig.

The modules are all installed sequentially under the rig floor and the rig is lifted gradually. Eventually, it is important to erect the derrick 15. The derrick 15 is extended by rotation from the full line position of FIG. 7 to the upright position. The mechanism for derrick 15 rotation, and the mechanism for telescoping movement of the sections 54 and 56 are both included in the equipment. At this moment, this leaves the drilling rig erected for commencement of drilling.

If need be, a corner located crane can be installed on the rig floor to reach out over the side and lift cargo from the hover craft. This cargo transfer mechanism can off load from the hover craft to the drilling rig all the needed equipment.

At the time of well completion, all the equipment can be removed in the reverse sequence. Conveniently, it is possible to dismount all the modules under the rig floor 12, and then remove the derrick. The heavy equipment module (see FIG. 6) is typically removed last. At that juncture, it is possible to leave the rig floor mounted on the derrick legs and convert it from a drilling rig into a production platform. By leaving the ratchet mechanisms 35 in a cooperative relationship to the four legs, easy manipulation of equipment onto and off of the rig floor is achieved so that well production equipment is then installed. After clearing the rig floor 12, the production equipment is placed on it. Again, the rig floor 12 can be raised or lowered so that it is relatively easy to onload and offload between hover craft and rig floor.

While the foregoing is directed to the preferred embodiment, the scope is determined by the claims which follow:

What is claimed is:

1. A method of transporting a drilling rig to a remote location over terrain preventing the use of trucks wherein the method comprises the steps of:

a. preparing the rig site to support a rig leg wherein the step of site preparation includes positioning a leg support at the rig site on the underlying soil;

b. moving by air a leg to the rig site to be placed on the support;

c. moving the rig floor to the rig site;

d. aligning the rig floor for movement along the rig leg;

e. moving by air a first module for the rig floor and attaching the module to the rig floor;

f. raising the rig floor with respect to the rig leg; and g. moving by air a second module connected below the rig floor.

2. The method of claim 1 wherein the steps occur in the order stated.

3. The method of claim 1 including the repeated steps of installing sufficient legs supported on the soil to collectively support the rig floor in an elevated position on the legs.

4. The method of claim 3 wherein the rig floor is connected to each leg.

5. The method of claim 4 including the step of relatively leveling the rig floor by adjusting the raised position of the rig with respect to each of the legs to accommodate soil variations supporting the several rig legs.

6. The method of claim 1 including the step of moving by air a rig equipment module supported by two or more hover craft wherein the equipment module is moved horizontally onto the top of the rig floor.

7. The method of claim 1 wherein a hover craft supports the first module on top of the rig floor, and said second module is off loaded by overhead connection to the either side of the rig floor.

8. The method of claim 7 wherein the second module to be lifted up from a hover craft.

9. The method of claim 1 including the step of connecting said second module under the rig floor, connecting a third module under the second module under the rig floor, and incrementally raising the rig floor to permit ingress and egress of an airborne craft moving said modules under the rig floor.

10. The method of claim 1 including the step of raising the rig floor on a sufficient number of legs to support and stabilize the rig floor above the soil wherein the legs are initially supported on the soil by forming a leg supporting granulated pad, and stabilizing the environmental conditions of the granulated pad and soil so that soil degradation is prevented after erection of the rig supported drilling floor.

11. The method of claim 10 including the step of installing a pad positioned cooling device to chill the pad site to protect permafrost soil.

12. The method of claim 11 wherein a pad positioned cooling device is under all of said rig legs.

13. The method of claim 1 including the step of moving the rig floor to the rig site supported on a hover craft, subsequently moving a derrick for connection with the rig floor by a second hover craft, placing the derrick on the rig floor, and connecting the derrick to the rig floor.

14. The method of claim 13 wherein the derrick is supported on a base and the base is slidably connected to the rig floor to position the derrick cantilevered over a side of the rig floor.

15. The method of claim 14 including the step of erecting the derrick from a first position to a second and upright position.

16. The method of claim 14 wherein said derrick is pivotedly mounted on the base and including the steps of erecting the derrick vertically above the base and extending the derrick to the required height for rig operation.

17. The method of claim 1 including the step of connecting the rig floor to the rig leg by positive connection, and including the steps of raising the rig floor on the rig leg incrementally supported by the positive connection, to move the rig floor upwardly to create a space below the rig floor size to receive at least one module under the rig floor and suspended therefrom.

18. The method of claim 17 including the step of raising the rig floor to suspend at least two modules.

19. The method of claim 1 including the step of connecting the modules to the rig floor for subsequent module removal, and wherein a derrick is installed for drilling and later removed to leave the rig floor and rig leg for conversion into a production platform.

20. A method of erecting a drilling rig at a remote site which cannot be approached by trucks or trailers traveling to that remote site wherein the method comprises:

a. clearing away any surface cover at the rig site to expose soil sufficiently firm to support weight thereon;

b. erecting on the cleared site a leg receiving support structure defining a rig leg foot print;

c. supporting a rig floor on a sufficient number of legs to stabilize the rig floor both at a lower position and at a raised position at a higher elevation wherein the rig floor moves along the legs; and d. air transporting rig modules to be connected below the rig floor to complete the rig.

* * * * *